US008657261B2

(12) United States Patent
Mehrkens

(10) Patent No.: US 8,657,261 B2
(45) Date of Patent: Feb. 25, 2014

(54) MOBILE SKI TOWING SYSTEM

(76) Inventor: Kyle John Mehrkens, Red Wing, MN (US)

( * ) Notice: Subject to any disclaimer, the term of this patent is extended or adjusted under 35 U.S.C. 154(b) by 95 days.

(21) Appl. No.: 13/330,183

(22) Filed: Dec. 19, 2011

(65) Prior Publication Data

US 2012/0187355 A1 Jul. 26, 2012

Related U.S. Application Data

(60) Provisional application No. 61/459,711, filed on Dec. 18, 2010.

(51) Int. Cl.
*B66D 1/00* (2006.01)

(52) U.S. Cl.
USPC ..... 254/323

(58) Field of Classification Search
USPC ..... 254/323–329; 242/557
See application file for complete search history.

(56) References Cited

U.S. PATENT DOCUMENTS 1,527,917 A * 2/1925 Ricketson et al. ..... 254/327
2,180,354 A * 11/1939 Frazier ..... 73/170.33
2,715,014 A * 8/1955 Garnett et al. ..... 254/326
3,000,588 A * 9/1961 Brady ..... 242/388.8
3,052,470 A * 9/1962 Pomagalski ..... 472/13
3,134,555 A * 5/1964 Baker ..... 242/594.3
3,190,646 A 6/1965 Forsman
3,303,813 A 2/1967 Collins
3,367,599 A * 2/1968 Thompson, Jr. et al. ..... 242/557
3,376,829 A * 4/1968 Hancock ..... 104/173.2
3,526,289 A * 9/1970 Rodgers ..... 180/7.1
3,779,171 A * 12/1973 Littlehorn, Jr. ..... 104/173.2
3,892,386 A * 7/1975 Hogan ..... 254/390
3,934,854 A * 1/1976 Goode ..... 254/134.3 R
3,964,425 A * 6/1976 Septor, Sr. ..... 242/390.8
4,042,941 A * 8/1977 Campbell et al. ..... 254/325
4,194,702 A * 3/1980 Ploeg ..... 242/394.1
4,204,354 A * 5/1980 Kane ..... 43/4.5
4,215,849 A * 8/1980 Charland ..... 254/326
4,339,096 A * 7/1982 May ..... 242/557
4,460,160 A * 7/1984 Tillotson ..... 254/386
4,650,163 A * 3/1987 Peterson ..... 254/327
4,754,825 A * 7/1988 Scheffer ..... 180/7.5
5,033,687 A * 7/1991 Bates ..... 242/592
5,054,745 A * 10/1991 Swayze et al. ..... 254/325
5,072,962 A * 12/1991 Webb ..... 280/414.1
5,120,185 A * 6/1992 Mummert ..... 414/563
5,215,278 A * 6/1993 Hess ..... 242/557
5,246,181 A * 9/1993 Straub et al. ..... 242/399.2

(Continued)

*Primary Examiner* — Emmanuel M Marcelo
*Assistant Examiner* — Michael Gallion
(74) *Attorney, Agent, or Firm* — Mitchell A. Rossman; Terra Nova Patent Law, PLLC

(57) ABSTRACT

A mobile ski towing system is a fixed or portable towing system used to pull a towee on a; ski, wakeboard, snowboard, longboard, surfboard, skateboard, mountainboard, or other similar ski or board, by reeling a towrope with a handle around a spool which is driven by a motor. There are three operating modes to control the towing independently or dependently of a dedicated-operator; a pull-to-start mode for independent towing, an on-board control mode for dependent towing, and a remote control mode for either independent or dependent towing. A mobile ski towing system comprises a mobile base with an outside frame and an internal pivoting frame, onto which the components of; motor, spool, spool shaft, spool shaft bearings, spider coulper and brake are mounted. The pivoting frame senses a load on the towrope to activate and deactivate the motor.

9 Claims, 10 Drawing Sheets

(56) References Cited

U.S. PATENT DOCUMENTS

| | | | | | |
|---|---|---|---|---|---|
| 5,273,257 | A * | 12/1993 | Perkins | 254/375 |
| 5,330,122 | A * | 7/1994 | Wood | 242/481.3 |
| 5,573,091 | A * | 11/1996 | Hung | 192/12 R |
| 5,636,648 | A * | 6/1997 | O'Brien et al. | 134/107 |
| 5,732,648 | A * | 3/1998 | Aragon | 114/254 |
| 6,276,503 | B1 * | 8/2001 | Laughlin, Jr. | 191/12.2 R |
| 6,290,271 | B1 * | 9/2001 | Geisler | 293/115 |
| 6,672,238 | B2 * | 1/2004 | Sheikholeslam et al. | 114/254 |
| 7,111,803 | B2 * | 9/2006 | Mott et al. | 242/397.4 |
| 7,997,827 | B2 * | 8/2011 | Fogg | 405/3 |
| 2004/0065767 | A1 * | 4/2004 | Parker | 242/557 |
| 2005/0124234 | A1 | 6/2005 | Sells | |
| 2006/0027155 | A1 | 2/2006 | Welch | |
| 2006/0071116 | A1 * | 4/2006 | Quenneville et al. | 242/557 |
| 2008/0083363 | A1 * | 4/2008 | Hart | 114/253 |
| 2008/0224110 | A1 * | 9/2008 | Starks et al. | 254/264 |
| 2009/0309082 | A1 * | 12/2009 | Webb et al. | 254/340 |
| 2012/0186483 | A1 | 7/2012 | Farr | |

* cited by examiner

MOBILE SKI TOWING SYSTEM

CROSS-REFERENCE TO RELATED APPLICATIONS

This application claims priority to U.S. provisional application 61/459,711 filed Dec. 18, 2010. This application incorporates by reference the subject matter disclosed in the provisional application.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1) Field of the Invention

The present invention relates to a towing system for pulling skiers and boarders. More particularly, the present invention relates to a fixed or portable towing system for pulling skiers and boarders. More particularly, the present invention relates to a fixed or portable, towee-controlled towing system for pulling skiers and boarders.

2) Description of Related Art Including Information Disclosed Under 37 CFR 1.97 and 1.98

There are numerous athletic and recreational activities available which need or can use a towrope to pull a person, a towee, holding onto a handle connected to a towrope. Examples of these include waterskiing, wakeboarding, wakeskating, kneeboarding, surfing, snow skiing, snowboarding, longboarding, mountainboarding, skateboarding, tubing, sledding, rollerblading, rollerskating, etc. Conventional technology requires assisted operation by another person other than the towee through the use of a navigable vehicle or towing machine such as; a boat, a jet ski, a snowmobile, a high-speed winch, or a large, pulley system that is expensive, fixed (i.e., not mobile), and requires one or more additional people to operate, such as the systems found at a wakeboard and waterski cablepark, two-tower cablepark, or downhill ski area. As a result, a person is not able to participate in these towing activities without the assistance of others nor without going to commercial facilities that provide these services.

Various types of operator-dependent towing systems have been devised to eliminate the need for a water, land or snow craft to tow the skier or boarder. One such operator-dependent towing system is disclosed in U.S. application Ser. No. 11/544,337, Publication number: US 2008/0083363 A1 Filing date: Oct. 6, 2006 (published Apr. 10, 2010) (L. Adam Hart, applicant), which discloses that a towee may be pulled by a stationary motor connected to a spool which winds a rope with a handle for the towee to hold, wherein an operator controls the speed and braking. The aforementioned disclosure of an operator-dependent towing system circumvents the need for a dry-land vehicle, snow vehicle or watercraft in motion to pull the towee, but does not eliminate the obligation to have a dedicated-operator control the towing of the towee, thus the towee cannot independently control the towing processes of start, stop and speed adjustment.

An aim to the present invention is to provide a towing system which is stationary relative to the towee, and allows for the towee to independently control the towing processes of start, stop and speed adjustment. There are two independent modes for controlling these processes; a pull-to-start mode and remote control mode.

It is a further aim of the present invention to provide dependent modes that function in parallel with the independent modes to control the start, stop and speed adjustment processes with a dedicated-operator. There are two dependent modes for controlling the towing processes; an on-board control mode and a remote control mode.

Still a further aim of the present invention is to allow the towee to easily move and relocate a mobile ski towing system to different locations. There are two modes of transportation; a manual-pull mode, a tow hitch mode.

BRIEF SUMMARY OF THE INVENTION

Various aspects of the invention disclosed herein allow a single individual, a towee, the ability to easily move and relocate a mobile ski towing system to different locations. Also, various embodiments of the invention allow a single individual, the towee, to then independently control the towing processes of start, stop and speed adjustment and, in turn, control the reeling of a towrope around a spool, and correspondingly, the speed at which the towee travels.

In one embodiment, the reeling of the towrope is achieved by a spool driven by an electric motor. The spool is part of a spool shaft which connects directly to the motor output shaft with two spider couplers. The motor is controlled by an electronic speed controller which varies the amount of current allowed to pass through the motor as a function of throttle input resistance of the parallel maximum speed and start-up speed potentiometers. The components of; motor, spool, spool shaft, spool shaft bearings, spider couplers, fairlead, brake drum, brake band, solenoid and electronic speed controller are mounted on a pivoting frame which senses a load on the towrope. Under load, the pivoting frame pivots forward towards the towee to activate the motor and maintain the motor activated. Under no load, the pivoting frame pivots backwards away from the towee to deactivate the motor and brake the spool. The back and forth pivoting motion of the pivoting frame allows the towing system to interpret a pull on the towrope as "on" and a lack of pull or load on the towrope as "off".

There are three different modes for controlling the towing processes; pull-to-start mode, on-board control mode, and remote control mode. Pull-to-start mode is for independent use and activates and deactivates the motor by a pull on towrope or releasing the towrope, respectively. On-board control mode is for dependent use and activates and deactivates the motor by a dedicated-operator pressing the start button to activate the motor and a dedicated-operator toggles a master switch to deactivate the motor. Remote control mode allows for independent and dependent use. In the remote control mode, either the towee or dedicated-operator presses the start button on a wireless remote control to activate the motor and a stop button on a wireless remote control to deactivate the motor. All three modes function in parallel and are dependent on the pivoting frame to sense a load on the towrope to maintain the motor active, brake the spool, and deactivate the motor.

BRIEF DESCRIPTION OF THE DRAWINGS

In drawings which illustrate the embodiments of the present invention.

DETAILED DESCRIPTION OF EMBODIMENTS OF THE PRESENT INVENTION

This section describes a mobile ski towing system. In some embodiments, the ski towing system is portable. This feature allows a user to take the ski towing system to a body of water, such as a lake or river, and set it up to ski on the water. Some embodiments of the mobile ski towing system disclosed are designed for a skier to activate and deactivate the system independently, without the use of a dedicated-operator. This feature enables skiers to be able to ski without having to find another person to operate the machine while skiing.

Figure 1:
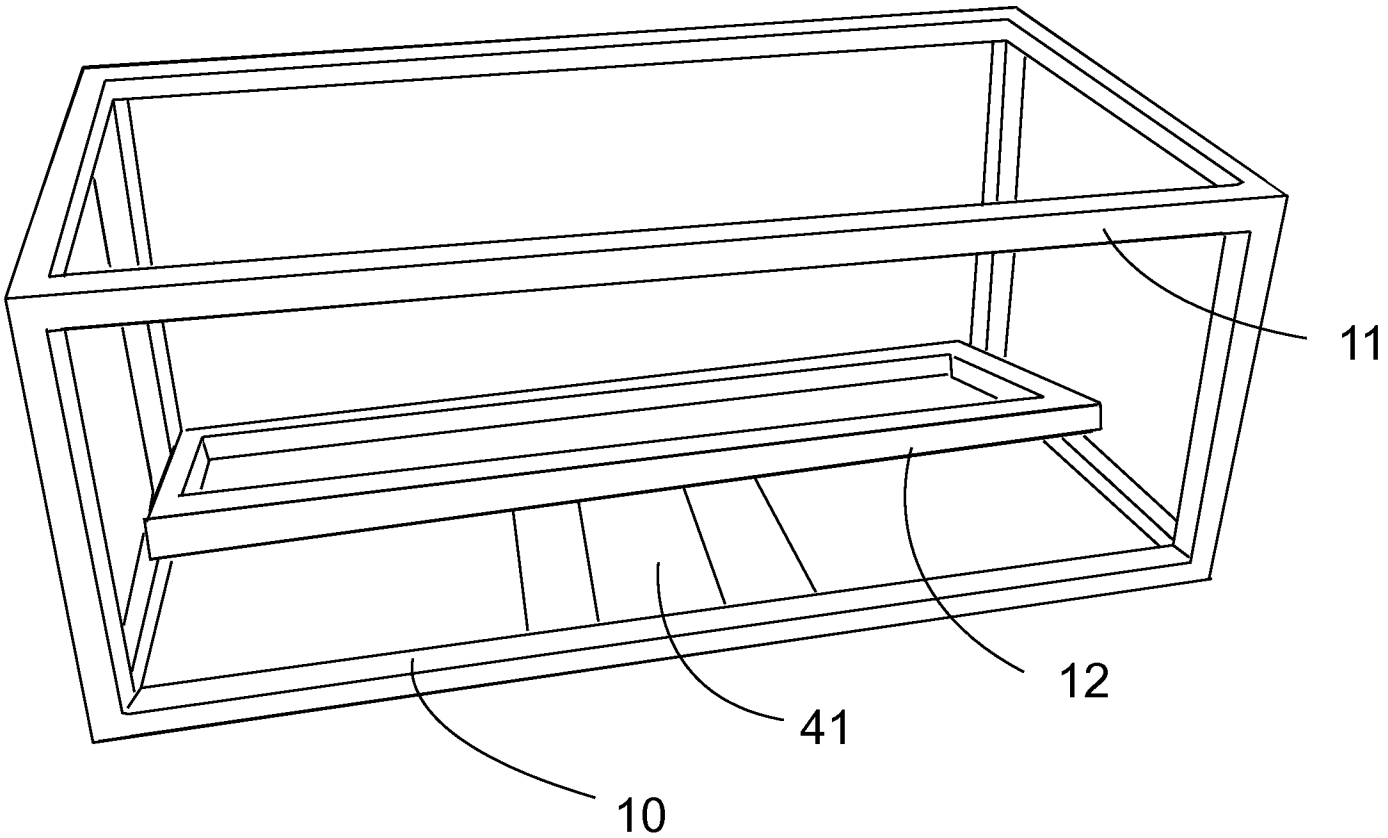
FIG. 1 is a schematic perspective drawing of a mobile base with an outside frame, which encompasses a pivoting frame, and a tow hitch mount at the rear of the mobile base.

In accordance with one aspect of the invention, FIG. 1 depicts a mobile base 10 of a mobile ski towing system without wheels, and onto which an outside frame 11 is mounted. The bottom side of the mobile base 10 has a pivoting frame 12 and thereunder is tow hitch mount 41.

Figure 2:
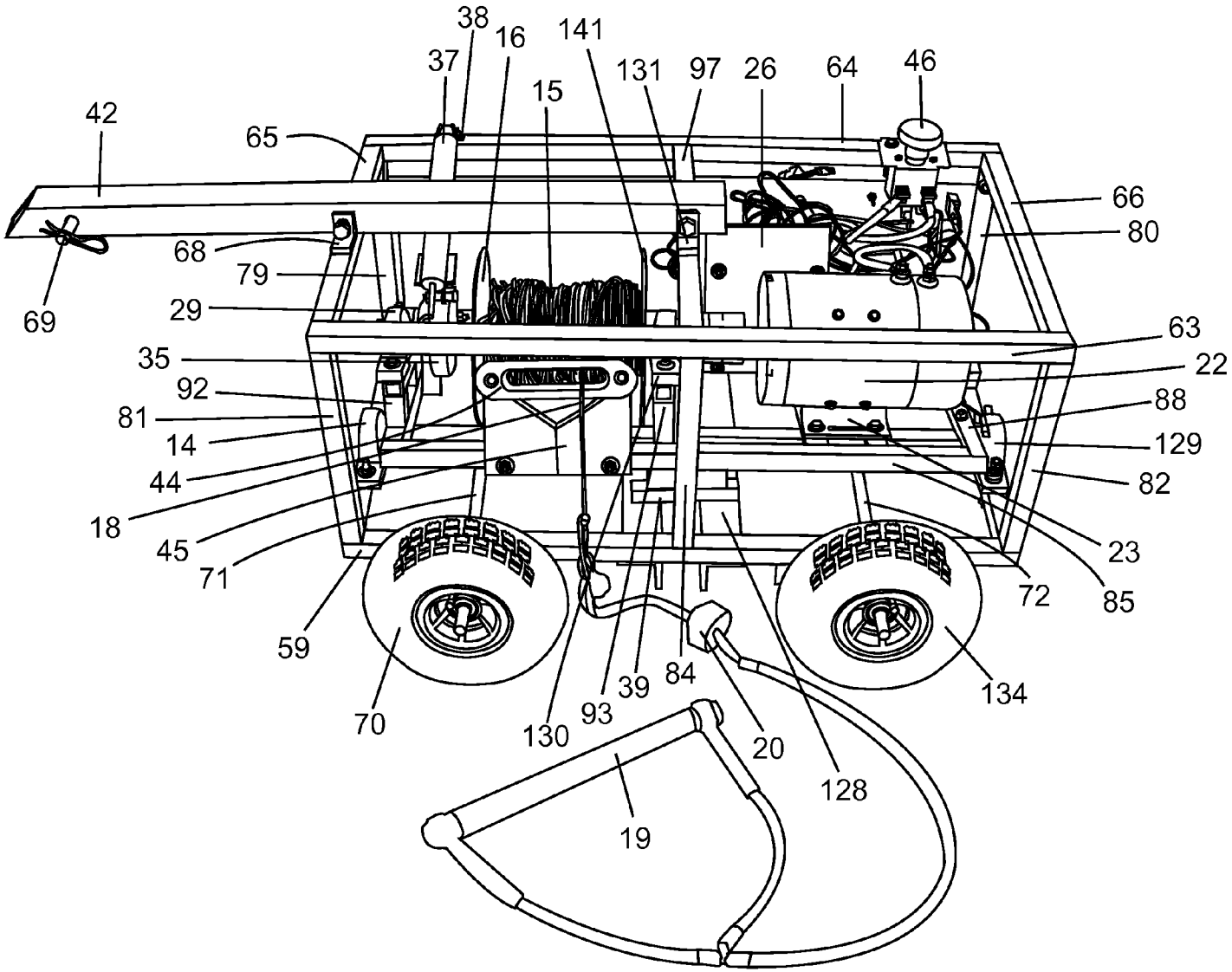
FIG. 2 is a front perspective view of a mobile ski towing system with the front and top covers removed to show a motor, spool, towrope and handle, pivoting frame, tow hitch connector, and wheels.
Figure 3:
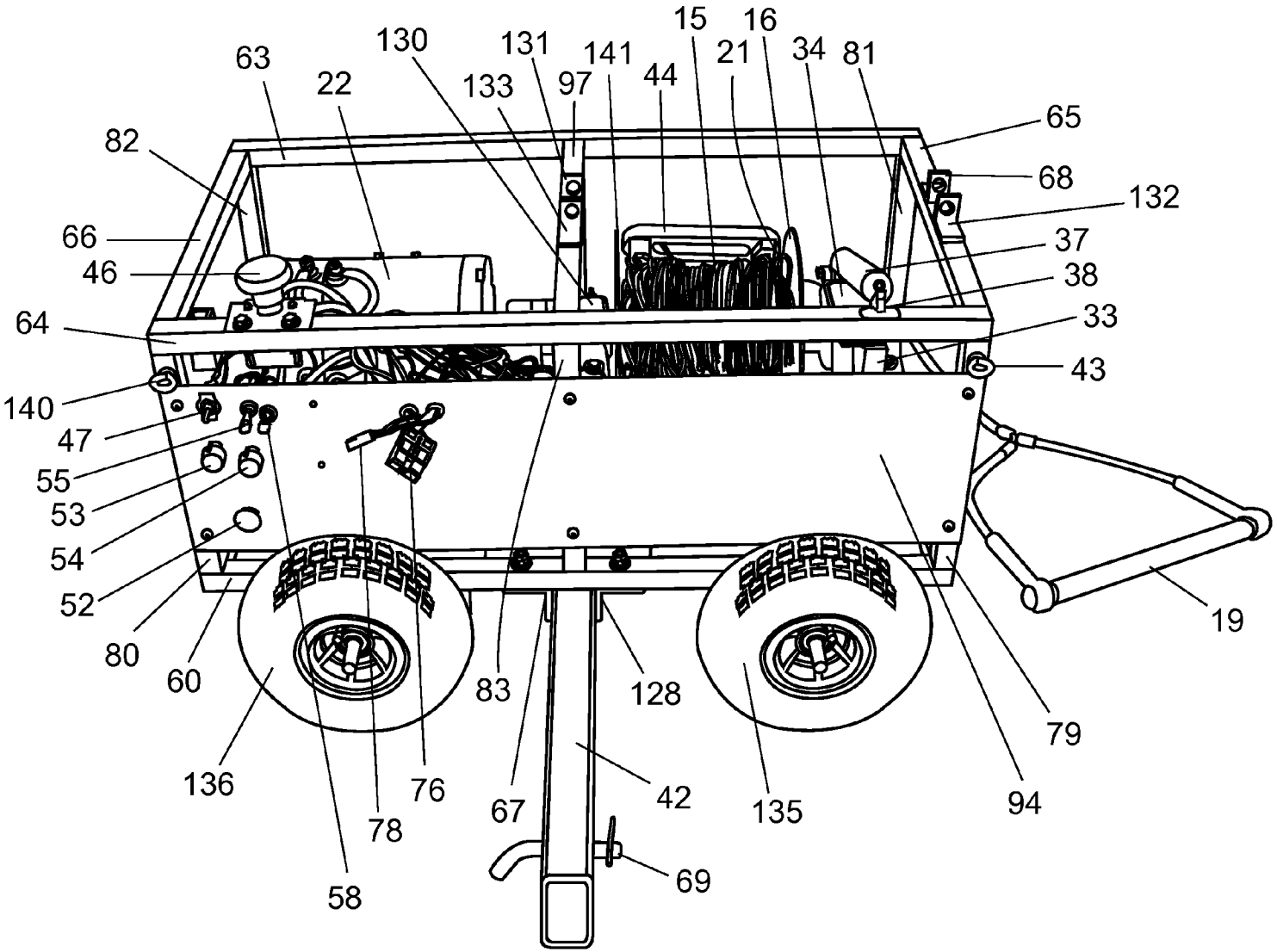
FIG. 3 is a rear perspective view of the mobile ski towing system of FIG. 2 showing the controls, wheels, and tow hitch connector.

Referring to FIG. 2 the mobile ski towing system has a mobile base 10 with an outside frame 11 made of welded braces 59, 60, 61, 62, 63, 64, 65, 66, 79, 80, 81, 82, 83, 84. For mobility, the bottom side of the mobile base 10 has a left axle 71, with a front wheel 70 and a rear wheel 135 as shown in FIG. 3. The mobile base 10 has a right axle 72 with a front wheel 134 and a rear wheel 136 as shown in FIG. 3.

Figure 5:
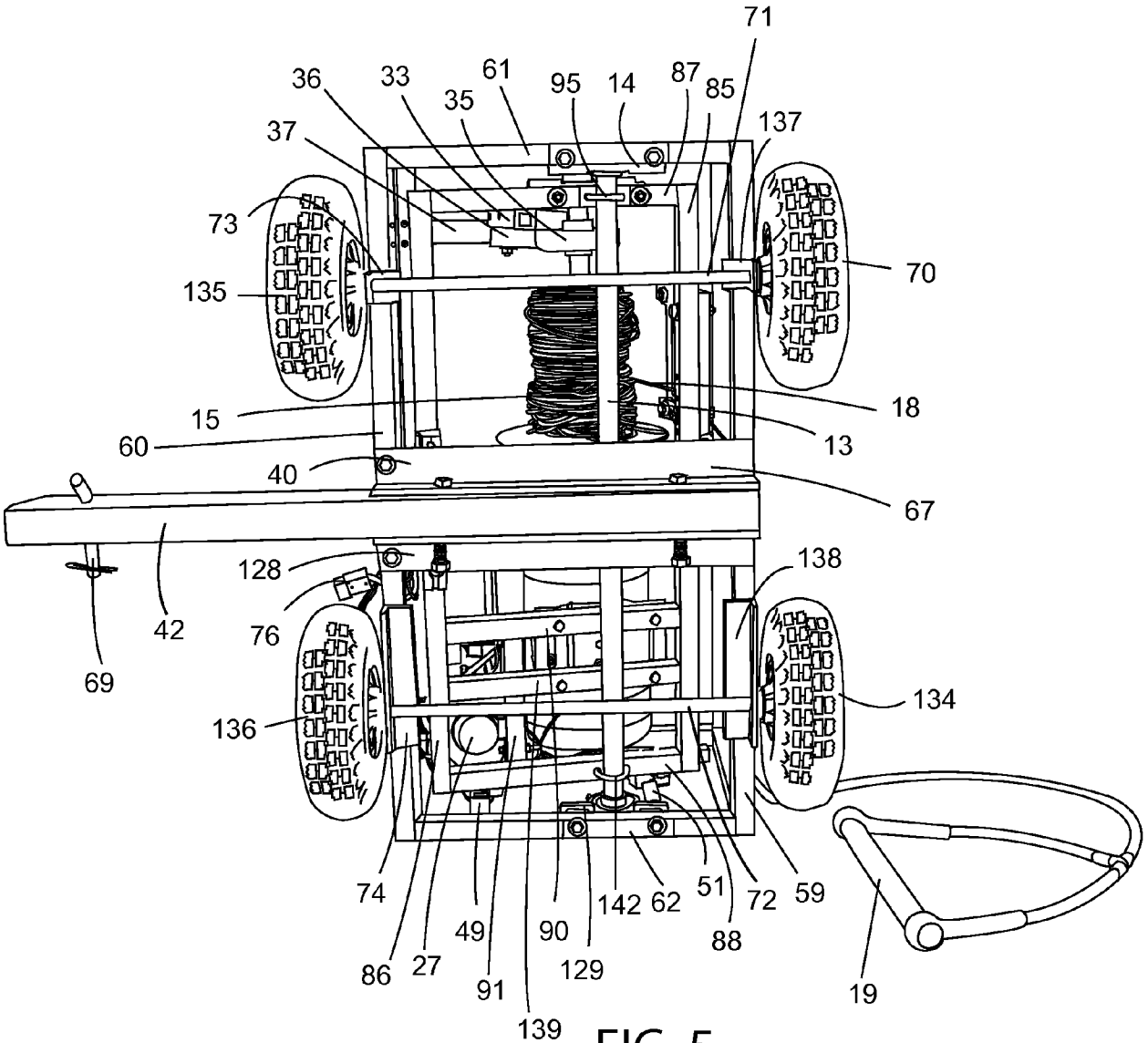
FIG. 5 is a bottom view of the mobile ski towing system of FIG. 2 showing a tow hitch connector, wheels, left and right axles, and pivoting frame shaft.

Referring to FIG. 5, the left axle 71 is supported by welded axle angle brackets 73, 137, which are welded to brace 60. The right axle 72 is supported by welded axle angle brackets 74, 138, which are welded to brace 59. The right axle angle brackets 74, 138 have three holes into which the right axle 72 can be inserted to adjust the center of gravity of the mobile base 10. The left axle angle brackets 73, 137 have only one hole into which the left axle 71 may be inserted. Both the left axle 71 and right axle 72 are longer than the mobile base 10 is wide from front to back, thereby allowing wheels 70, 134, 135, 136 to be attached to provide mobility. The wheels 70, 134, 135, 136 are secured to the left axle 71 and right axle 72 by a cotter pin inserted through a small hole on either end of the left axle 71 and right axle 72.

Figure 4:
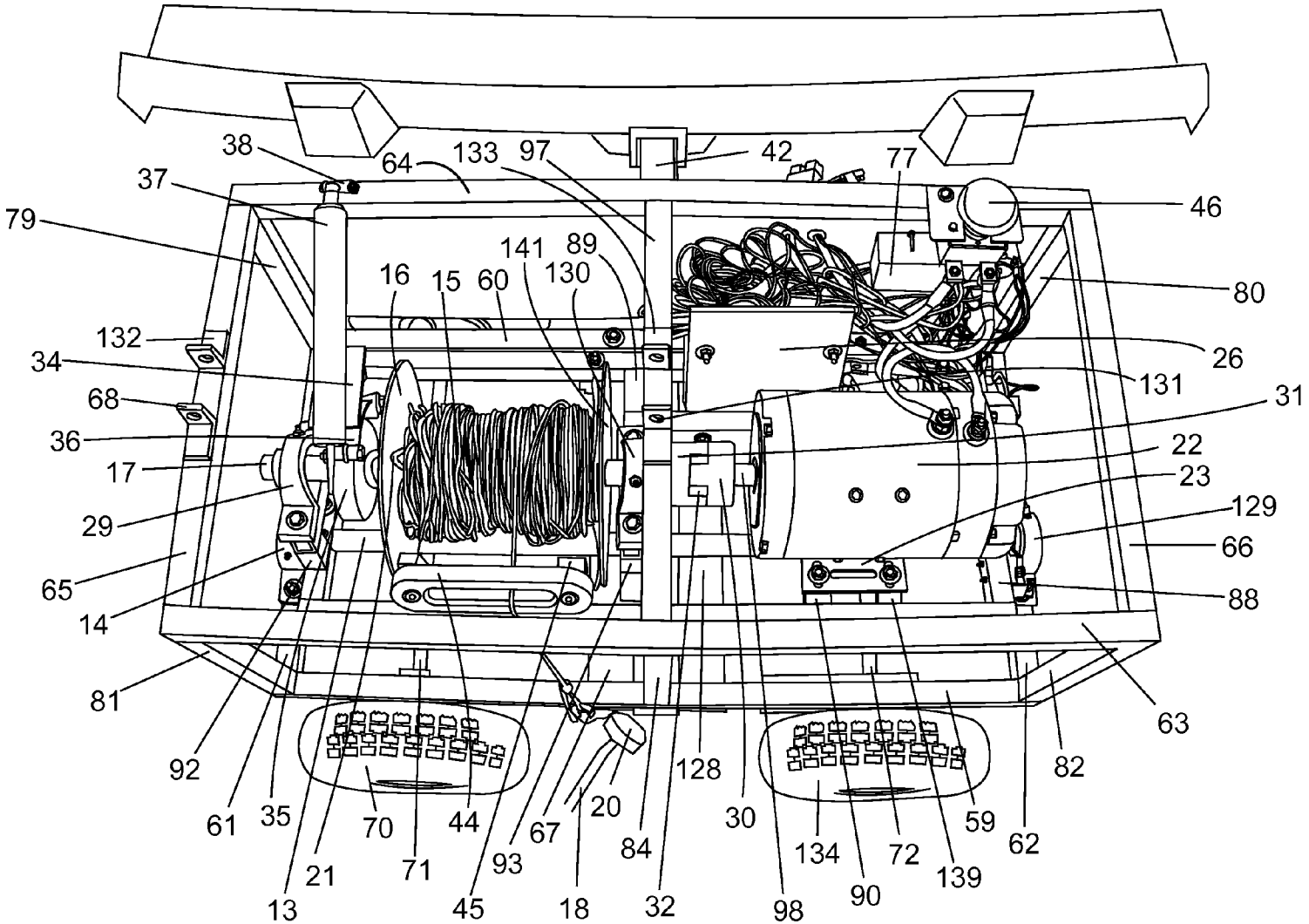
FIG. 4 is a top perspective view of the mobile ski towing system of FIG. 2 attached to a secondary vehicle by a tow hitch connector, showing the motor, spool, brake drum, brake damper and fairlead.

The mobile ski towing system may also be attached to a tow hitch receiver of a secondary vehicle for mobility as shown in FIG. 4. The bottom side of the mobile base 10 has a tow hitch mount 41 into which a tow hitch connector 42 is inserted. The tow hitch mount 41 is made of two spaced and parallel angle brackets 67, 128 which run from front to back and are parallel to the left axle 71 and right axle 72. The tow hitch connector 42 made of carbon steel is used to connect the mobile ski towing system to a tow hitch receiver of a vehicle. The tow hitch connector 42 inserts into the tow hitch mount 41 and is secured by two bolts. The tow hitch connector 42 also inserts into the tow hitch receiver of a vehicle and is secured by a lock pin 69 shown in FIG. 6.

The mobile base 10 is stationary relative to the towee when in use and is secured by a rope, cable or tow hitch connector 42 to an anchor, such as a tree, ground stake, secondary vehicle or other immobile object. The tow hitch connector 42 provides a rope-less or cable-less means to anchor the mobile base 10 to a vehicle, which can be used as an anchor as well as for mobility. Referring to FIG. 3, anchor eye bolts 43, 140 attached to the rear vertical braces 79, 80 provide a means to connect a rope or cable to the mobile base 10.

Inside the mobile base 10 is a pivoting frame 12 which is fixed to a pivot shaft 13 by two u-bolts 95, 142 one on each side of the pivoting frame 12 braces 87, 88 shown in FIG. 5. The pivot shaft 13 is longer than the length of the pivoting frame 12 from left to right and is fixed to the mobile base lower horizontal braces 61, 62 by pivot shaft bearings 14, 129, one on each end of the pivot shaft 13. The pivot shaft bearings 14, 129 allow the pivoting frame 12 to pivot towards the front and back of the towing system. The pivoting frame 12 center of gravity center is to the rear of the mobile base 10 with no load on a towrope 18 and the mobile base 10 level to the horizon line, therefore the pivoting frame 12 is at rest and pivoted backwards due to the force of gravity.

Still referring to FIG. 5, the pivoting frame 12 is made of square aluminum braces 85, 86, 87, 88, 89, 90, 139. A horizontal strengthening brace 91 is welded for strength on the topside of braces 88, 89, 90, 139. Spool shaft bearing mounts 92, 93 made of square aluminum tubing are welded on top of braces 87, 88. A front pivoting frame stop 39, shown in FIG. 2, is made of aluminum and plastic and is mounted under brace 85. Referring back to FIG. 5, a rear pivoting frame stop 40 made of plastic is mounted under brace 86. Plastic is used to eliminate metal-on-metal contact to prolong the life of the parts.

When the front pivoting frame stop 39 makes contact with the topside of the tow hitch mount 41, the pivoting frame 12 is at the maximum frontward pivot position, which is the fully-activated position. When the rear pivoting frame stop 40 makes contact with the topside of the tow hitch mount 41, the pivoting frame 12 is at the maximum backward pivot position, which is the off position. When neither the front pivoting frame stop 39 nor the rear pivoting frame stop 40 make contact with the top side of the tow hitch mount 41, the pivoting frame 12 is either pivoting forward or backward, which is the start-up speed position.

Referring to FIG. 4, a spool shaft 17 with a keyway is supported by a left spool shaft bearing 29 and a right spool shaft bearing 130 which allow for rotation of the spool 15.

The left spool shaft bearing 29 is mounted on top of the left spool shaft bearing mount 92 and the right spool shaft bearing 130 is mounted on top of the right spool shaft bearing mount 93. The spool 15 is on the right side of the spool shaft 17. The spool 15 and spool shaft 17 are machined from one piece of solid round steel with the spool 15 having a greater diameter than the spool shaft 17. Two flanges 16, 141 made of carbon steel have a hole in the center as big as the spool shaft 17 diameter and are welded on each side of the spool 15. The flanges 16, 141 have a greater diameter than the spool 15 to keep a towrope 18 from falling off the spool 15. The towrope 18 is wound onto the spool 15 with one end of the towrope 18 tied to the spool 15 and the other end of the towrope 18 is passed through a fairlead 44 and tied to a handle 19. The fairlead 44 is mounted next to the spool 15 on brace 85 of the pivoting frame 12 by a fairlead bracket 45 made of plastic. The fairlead bracket 45 is made of plastic to absorb impact in case a stopper 20 hits the fairlead 44 in the event the motor 22 does not deactivate before the stopper 20 hits the fairlead 44.

A direct-current series-wound motor 22 is mounted on the pivoting frame 12 and drives the spool 15. It has keyed output shaft 98 which connects to spool shaft 17 by spider couplers 30, 31. The spider couplers 30, 31 interlock with a flexible rubber star coupler 32 therebetween and are fixed to the spool shaft 17 and output shaft 98 by keys and set screws. The flexible rubber star coupling 32 absorbs shock and provides a smooth power transfer. The motor 22 is mounted on top of braces 90, 139 by a motor mount bracket 23 and four bolts, which can be seen in FIG. 5.

Figure 6:
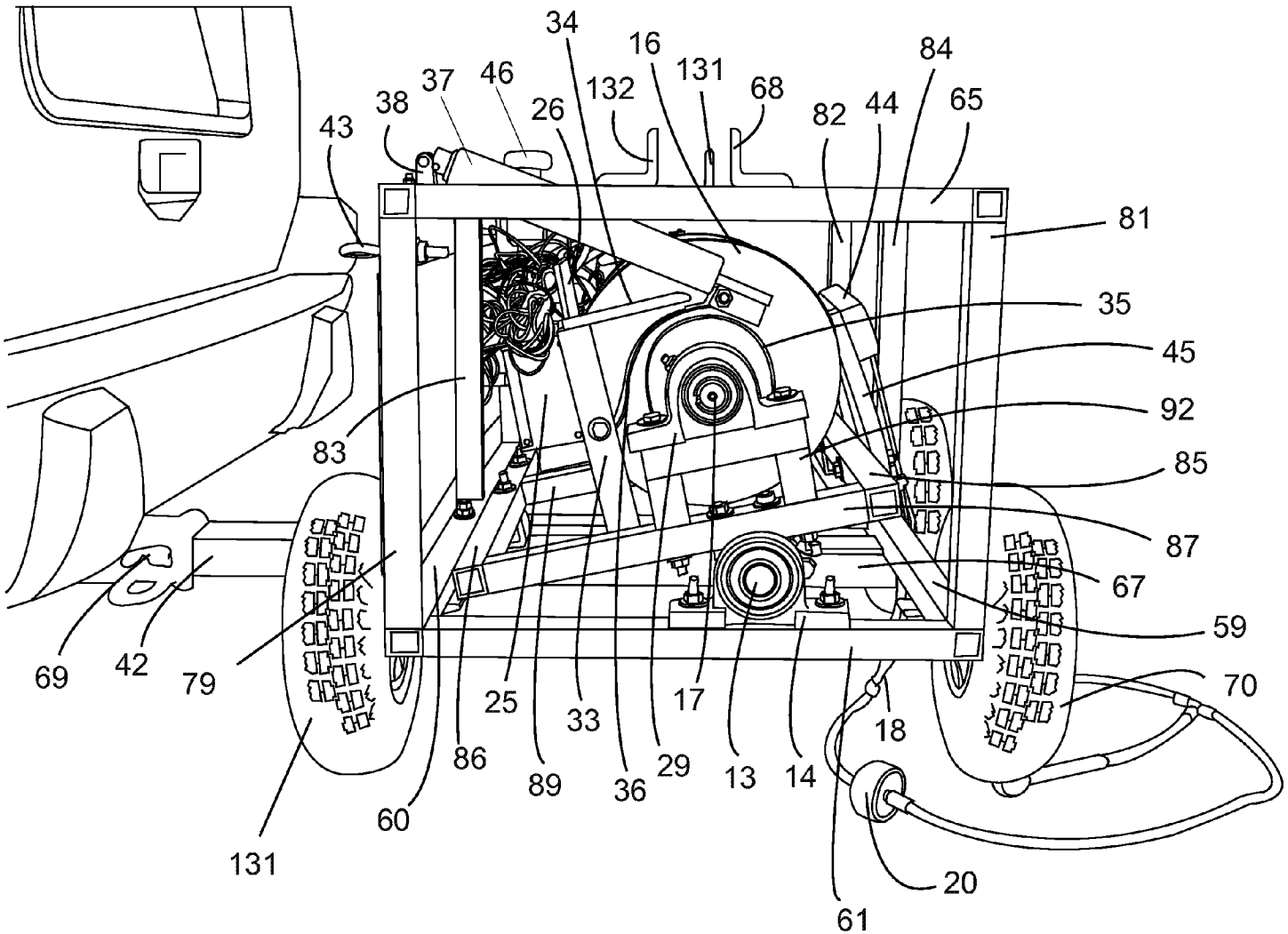
FIG. 6 is a left side view of the mobile ski towing system of FIG. 2 attached to a secondary vehicle by a tow hitch connector, showing a spool flange, brake damper, brake stop, brake drum and brake band.

Referring to FIG. 6, a drum brake 35 is mounted on the spool shaft 17 next to the left spool shaft bearing 29 by a key and set screw. The brake band 36 is fixed and mounted to an aluminum brake bracket 33. The brake bracket 33 is welded to brace 87 of the pivoting frame 12. The brake band 36 is positioned above the brake drum 35 and mounted to a brake damper 37 by a bolt. The brake damper 37 actuates and is fixed to brace 64 by a brake damper bracket 38 by two bolts. An aluminum brake band stop 34 is welded to the top of the brake bracket 33. The brake band stop 34 sets the maximum distance the brake band 36 can move away from the drum brake 35, which is called the maximum brake-band-to-brake-drum clearance.

As the pivoting frame 12 pivots forward, the brake band 36 stays with the brake damper 37 until the brake band stop 34 makes contact with the brake band 36. As the pivoting frame continues to pivot forward to the fully-activated position, the brake band 36 is at rest against the brake band stop 34 and brake damper 37 is forced to actuate and extend downward and to the front by the brake band stop 34 until the front pivoting frame stop 39 makes contact with the tow hitch mount 41. With the pivoting frame 12 at the fully-activated position, the drum brake 35 has no contact with the brake band 36, therefore the spool shaft 17 is free to rotate.

As the pivoting frame 12 pivots backwards, the brake damper 37 resists the backwards pivoting of the pivoting frame 12 and pushes the brake band 36 downward onto the top of the drum brake 35 to make contact. The brake damper 37 is pneumatic and is adjustable which allows for a slower or faster return of the pivoting frame 12 to the off position, thus having more or less time to apply the brake band 36 on the drum brake 35, which slows the rotation of the spool 15 as the pivoting frame 12 pivots backwards. The brake band 36 holds contact with the drum brake 35 after the pivoting frame stop 39 makes contact with the tow hitch mount 41 at the off position until the brake damper 37 fully retracts. Then the brake band 36 releases from the drum brake 36 and allows the spool shaft 17 to rotate freely again.

Figure 7:
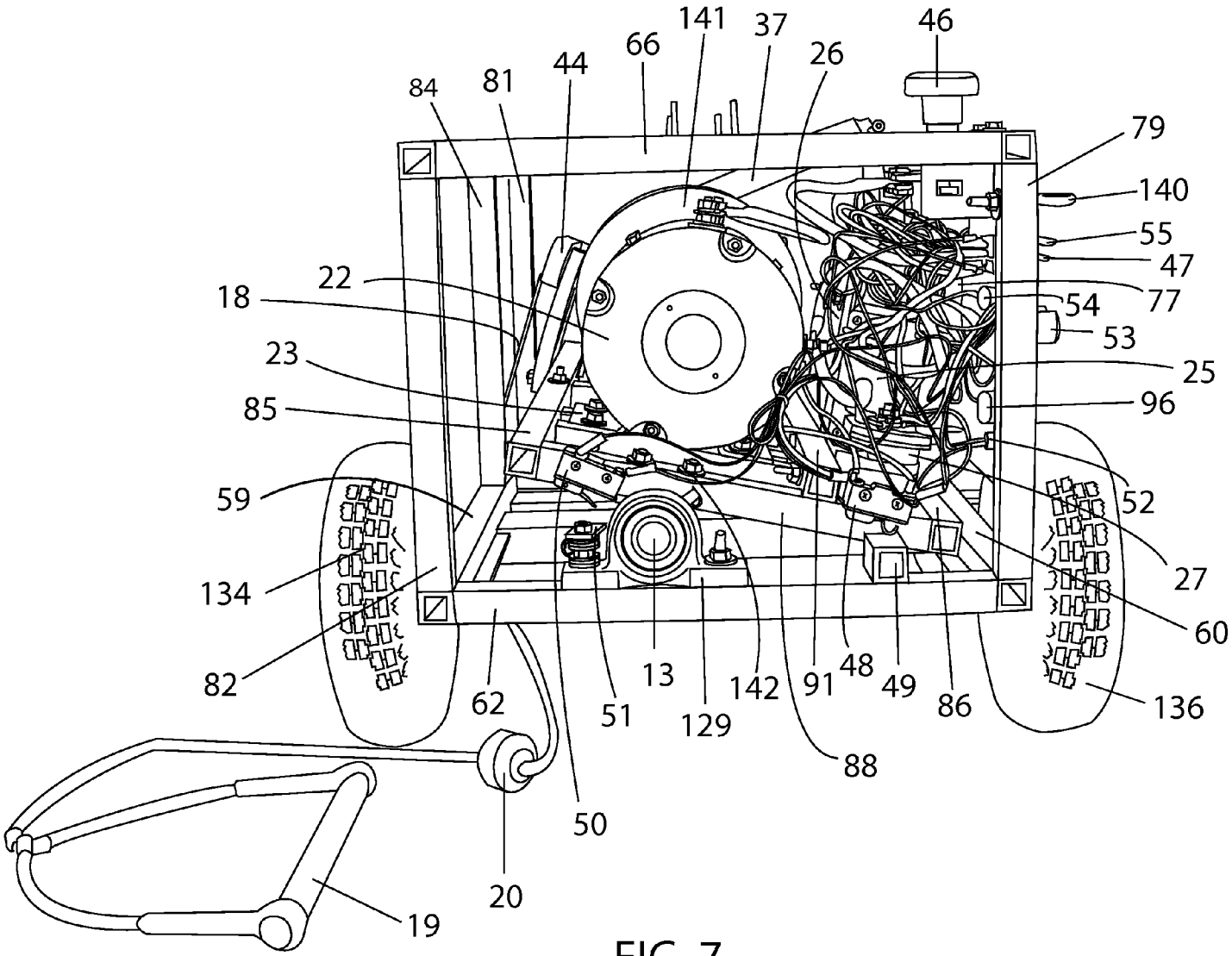
FIG. 7 is a right side view of the mobile ski towing system of FIG. 2, showing a motor, electronic speed controller, and solenoid.

Referring to FIG. 7. an electronic speed controller 25 is mounted on an aluminum flat plate 26 by four bolts, which also serves as a heat sink for the electronic speed controller 25. The flat plate 26 is mounted vertically on the rear side of the pivoting frame horizontal strengthening brace 91 by two bolts. The flat plate 26 is oriented so that the electronic speed controller terminals 105, 106, 107, 108, 109, 110, 111 face the right side of the mobile base 10.

Figure 10:
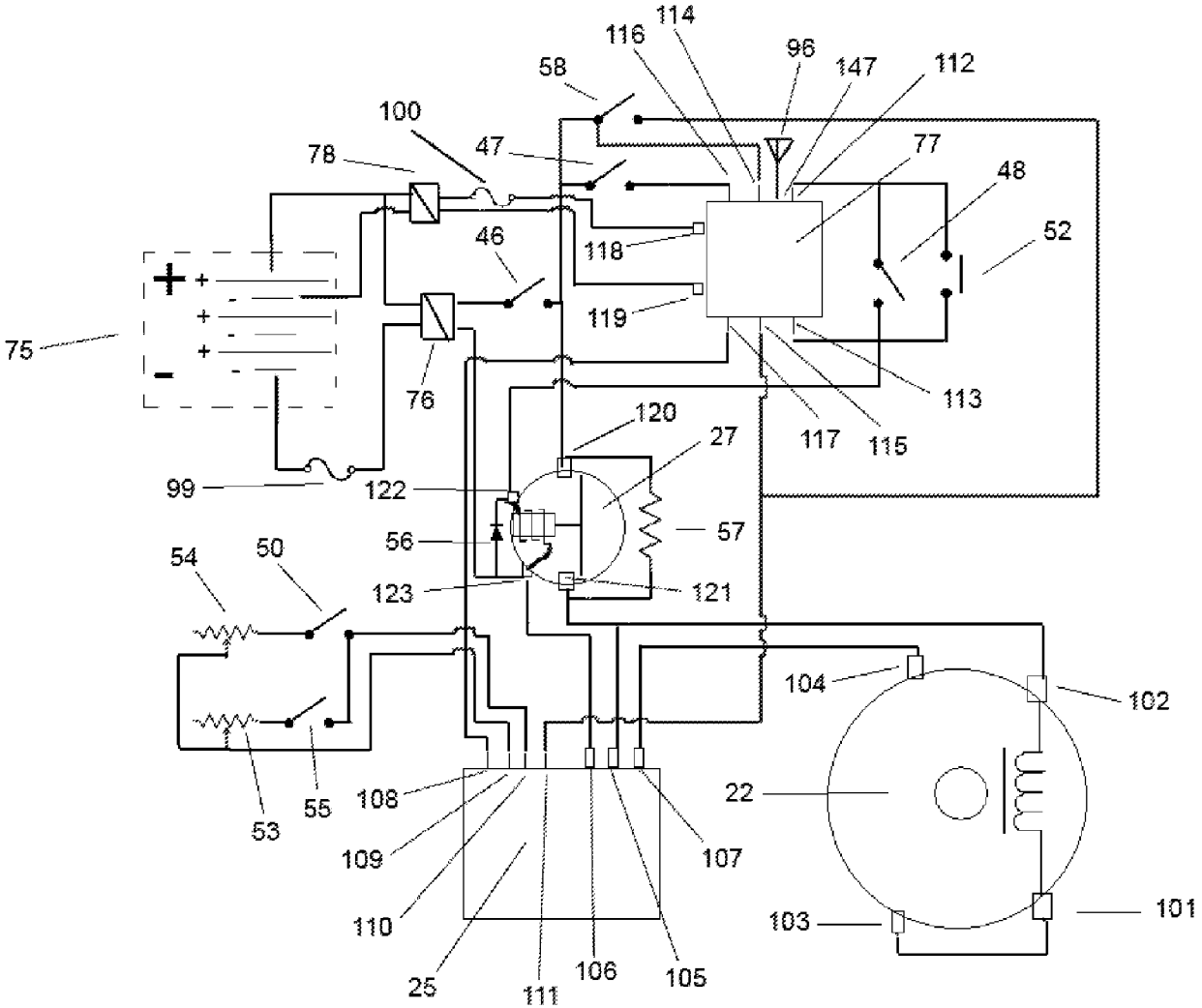
FIG. 10 is a schematic representation of the electronics in the mobile ski towing system shown in FIG. 2.

Referring to FIG. 10, the electronic speed controller 25 has seven terminals, battery positive 105, battery negative 106, motor negative 107, throttle input 109, throttle input 110, half-speed input 111, and power on input 108. The electronic speed controller 25 varies the amount of current allowed to pass through the motor 22 as a function of the throttle input resistance of the parallel maximum speed potentiometer 53 and start-up speed potentiometer 54, and correspondingly the speed at which the motor 22 rotates.

Figure 8:
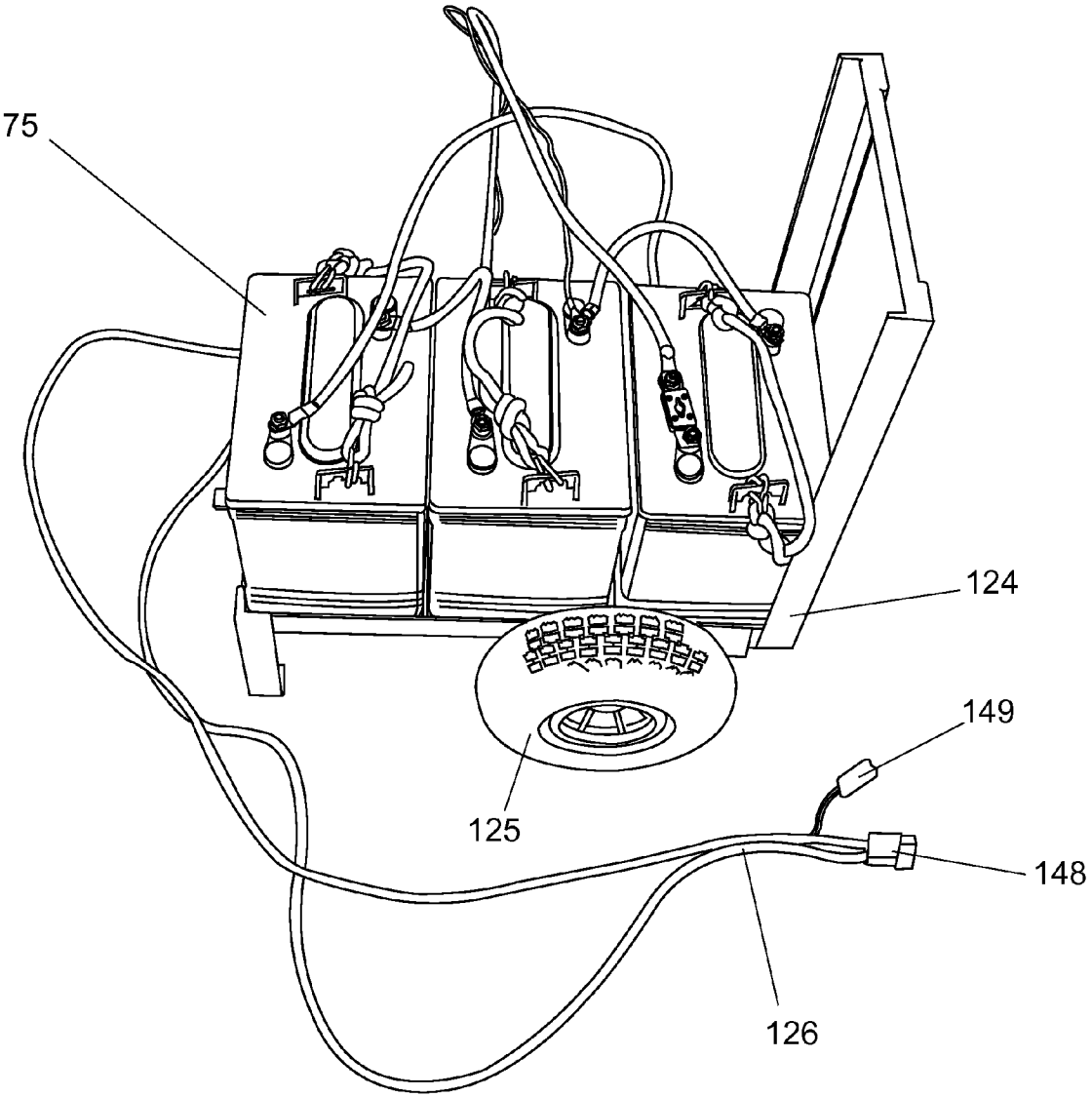
FIG. 8 is a battery supply on a mobile cart with a battery connector used to power the mobile ski towing system shown in FIG. 2.

Referring to FIG. 8, a battery supply 75 of three batteries in series powers the motor 22. The battery supply 75 rests on a mobile cart 124 with wheels 125 to allow for mobility. The battery supply 75 has a wiring harness 126 with a battery connector 148 that connects to the mobile ski towing system battery connector 76 and has a fuse 99 to protect from unsafe high current draw as shown in FIG. 10.

Referring back to FIG. 8, the battery supply wiring harness 126 has a wireless module connector 149, which connects to a wireless remote control module connector 78 for powering a wireless remote control module 77 as shown in FIG. 10. A wireless remote control module 77 is mounted to the rear cover 94 by two screws and allows for remote control of the mobile ski towing system through a wireless remote control 143.

Still referring to FIG. 10, the wireless remote control module 77 connects to the battery supply 75 by a wireless remote control module battery connector 78 as shown in FIG. 3. Referring back to the FIG. 10, the wireless remote control module 77 has a fuse 100 to protect the wireless remote control module 75 from unsafe high current draw. The wireless remote control module 77 has eight terminals 112, 113, 114, 115, 116, 117, 118, 119 and an external antenna connection 147 with an external antenna 96, which is mounted on the rear cover 94 as shown in FIG. 7.

Referring to FIG. 10, the emergency stop button 46 disconnects the power in case of an emergency by manual pressure. The positive lead of the emergency stop button 46 connects to a solenoid switch input 120. Once the emergency stop button 46 closes, there are five on-board controls 47, 52, 53, 54, 55, 58 and three wireless remote control buttons 144,145,146 for controlling the mobile ski towing system.

The master switch 47 switches power to the electronic speed controller 25. The half speed switch 58 signals the electronic speed controller 25 to operate at half speed. In series with the master switch 47 is a wireless remote control deactivate button 146, which is relay-driven in the wireless remote control module 77 and has an input 116 and an output 117. The master switch 47 and wireless remote control start button 144 close to power the electronic speed controller 25.

The half-speed switch 58 is in parallel with the wireless remote control half-speed button 145 which is relay-driven in the wireless remote control module 77 and has an input 114 and an output 115. The half-speed switch 58 or wireless remote control half-speed button 145 signals the electronic speed controller 25 to operate at half-speed as they are in parallel.

The electronic speed controller 25 has four controls 50,53, 54, 55 for controlling the rate at which the current passes through the motor 22 and the amount of current to pass through the motor 22. A maximum speed potentiometer 53 and a start-up speed potentiometer 54 connect to the throttle inputs 109,110 to control the rate at which the current passes through the motor 22. A maximum speed switch 50 disables the start-up speed potentiometer 54 to allow the current to pass through the motor 22 at the rate set by the maximum speed potentiometer 53 by making contact with a maximum speed switch stopper 51 shown in FIG. 7. Referring to FIG. 10, a maximum speed disable switch 55 disables the maximum speed potentiometer 53 to allow the current to pass through the motor 22 at the rate set by the start-up speed potentiometer, which is for low speed operation for beginners.

The motor 22 has four electrical posts. The two field posts 101,102 and the two armature posts 103,104. The field and armature are together in series inside a series motor by definition of a series motor. The field post 102 connects to a solenoid switch output 121. The field post 101 connects to the armature input post 103. The armature output post 104 connects to the electronic speed controller 25 motor negative terminal 107 and then to a battery negative post 106 internally in the electronic speed controller 25. The battery negative post 106 connects to a solenoid negative post 123 and the negative lead of the battery connector 76.

A solenoid 27 is mounted next to the electronic speed controller 25 on the pivoting frame horizontal strengthening brace 91 by two bolts as shown in FIG. 7. Referring back to FIG. 10, the solenoid 27 switches power to the electronic speed controller 25. The solenoid 27 has four posts 120,121, 122,123. The solenoid 27 is oriented with the four posts 120,121,122,123 facing the top of the mobile base 10.

The solenoid 27 has an internal coil by definition of a solenoid and connects the solenoid coil negative post 123 to the solenoid coil positive post 122 with a diode 56 in parallel to prevent erroneous motor 22 speed readings inside the electronic speed controller 25. The solenoid coil negative post 123 also connects to the battery connector 76.

The solenoid 27 is switched by three parallel controls 48, 52, 144 that allow current to flow through the solenoid coil positive post 122 and the solenoid coil negative post 123 and then completing the circuit between the solenoid switch input 120 and solenoid switch output 121, which connects the battery supply 75 to the motor 22. The solenoid switch input 120 and solenoid switch output 121 have a precharge resistor 57 wired in parallel to minimize arcing inside the solenoid 27.

Figure 9:
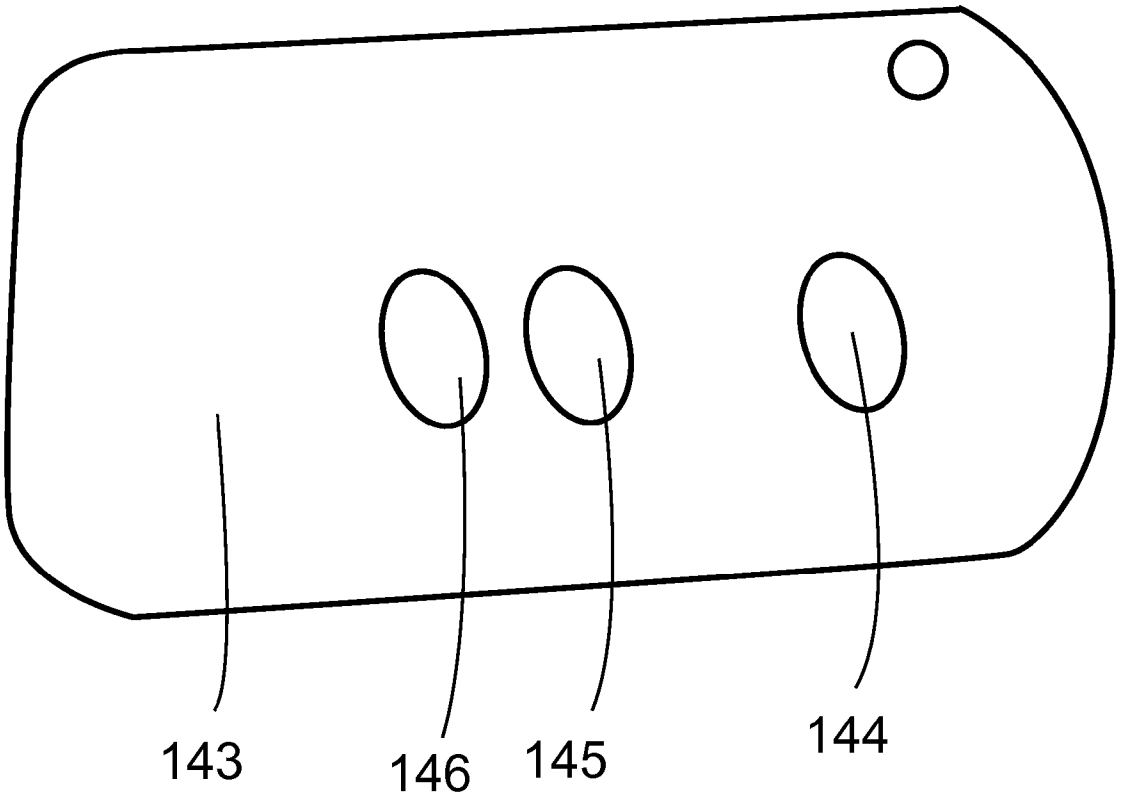
FIG. 9 is a wireless remote control used to remotely control the mobile ski towing system shown in FIG. 2.

Referring to FIG. 3, a start button 52 is a momentary switch that is mounted on the rear cover 94. Once pressed, the start button 52 allows current to pass through the solenoid 27. Referring to FIG. 9, a wireless remote control start button 144 is momentary and part of the wireless remote control 143. The wireless remote control start button 144 is relay-driven in the wireless remote control module 77 and has an input 112 and an output 113 as shown in FIG. 10. The wireless remote control start button 144 allows current to pass through the solenoid 27. A solenoid switch 48 is mounted the rear of the pivoting frame 12 and closes to allow current to through the solenoid 27 when the pivoting frame 12 pivots forward.

A pull-to-start mode is used to pivot the pivoting frame 12 and activate the motor 22. Pull-to-start mode allows for independent use without a dedicated-operator. The towrope 18 is unreeled to the desired length, which sets the length of the ride. When the towrope 18 is at the desired ride length, a locking link 21 manually placed around the closest portion of unwound towrope 18 near the spool 15 and any easily accessible loose wind of towrope 18 on the spool 15 by passing both portions of towrope 18 into the locking link 21 and locking it. This prevents further unreeling of the towrope 18 past the desired length.

The battery supply 75 is manually connected and the emergency stop button 46 and master switch 47 are manually closed, which turns the electronic speed controller 25 on. Then the maximum speed potentiometer 53 and the start-up speed potentiometer 54 are manually set to the desired limits, which determine top speed and start-up speed, respectively. Finally the towee goes to the ride starting point with the handle 19 in hand. The towrope 18 stops unreeling at the desired ride length because the locking link 21 prevents further unreeling. With the towrope 18 near taught, the towee pulls the handle slightly, which pivots the pivoting frame 12 and activates the motor 22.

The towrope 18 is unable to unreel due to the locking link 21, therefore transferring the applied force to the spool 15 and correspondingly the spool shaft 17, which is secured to the pivoting frame 12 by a spool shaft bearings 29,130. The pivoting frame 12 is unbalanced and heavy on the rear side, so the motor 22 remains deactivated in the off position until the applied force on the towrope 18 overcomes the force of gravity on the pivoting frame 12, thereby rotating the pivoting frame 12 forward enough to close the solenoid switch 48, which is open against solenoid switch stopper 49 at the off position, as shown in FIG. 7, and switches the solenoid 27 to connect power to the motor 22 at the rate set by the parallel resistance of the maximum speed potentiometer 53 and the start-up speed potentiometer 54.

As the pivoting frame 12 continues to pivot forward, the brake band stop 34 makes contact with the brake band 36 and forces the brake damper 37 actuate out and forward with the rotation of the pivoting frame 12. When the pivoting frame front stop 39 makes contact with the tow hitch mount 41, the maximum speed switch 50 opens to disconnect the start-up speed potentiometer 54, thereby allowing the motor 22 to rotate at the speed set by the maximum speed potentiometer 53.

When the towee releases the handle 19, the force of gravity on the pivoting frame 12 overcomes that of the applied force on the towrope 18, and correspondingly the pivoting frame 12 begins to pivot backward towards the off position. First, the maximum speed switch 50 closes and the motor 22 slows down because resistance of the throttle inputs 109,110 is less with the start-up speed potentiometer 54 in parallel with the maximum speed potentiometer 53. Second, the brake damper 37 resists the force of gravity on the pivoting frame 12 by applying a force onto the brake band 36. The force of gravity on the pivoting frame 12 is more than that of the force applied to the brake band 36 by brake damper 37, so the brake drum 35 makes contact with the brake band 36 and pushes against the brake damper 37 to start the retraction of the brake damper 37. While the pivoting frame 12 is rotating backward, the brake band 36 is applied on the brake drum 35 until a pivoting frame rear stop 40 makes contact with the tow hitch mount 41. When the pivoting frame rear stop 40 makes contact with tow hitch mount 41, the solenoid switch 48 opens to disconnect power to the solenoid 27 which prevents any current from flowing through the motor 22. The pivoting frame 12 is then in the off position and brake damper is fully retracted, which releases the brake band 36 from the brake drum 35 and the spool 15 is able to rotate again for the towee to go back to the starting point for the next ride.

The on-board control mode is for dependent use and functions in parallel with the pull-to-start mode. The towrope 18 riding length does not need to be set to the desired length for on-board control mode because the dedicated-operator activates the motor 22. The desired length can be set, so that the towee can activate the motor 22 with the pull-to-start mode if desired.

As with the pull-to-start mode, the battery supply 75 is manually connected and the emergency stop button 46 and master switch 47 are manually closed, which turns the electronic speed controller 25 on. Then the maximum speed potentiometer 53 and the start-up speed potentiometer 54 are manually set to the desired limits prior to activating the motor 22. With the towee at the starting point with the handle 19 in hand, the dedicated-operator presses and holds the start button 52 to activate the motor 22. Once the towee is riding, the pivoting frame 12 is in the fully-on position and the dedicated-operator releases the start button 52. The start button 52 is in parallel with the solenoid switch 48, so the difference between activating the motor 22 in the pull-to-start mode to the on-board control mode is the dedicated-operator presses the start button 52 to activate the motor 22 rather than the towee pulling on the towrope 18 to activate the motor 22. The dedicated-operator can adjust the speed of the motor 22 while the towee is riding by adjusting the maximum speed potentiometer 53. When the towee releases the handle 19, the pivoting frame 12 pivots backwards to the off position, the brake damper 37 applies the brake band 36 on the drum brake 35 to stop the rotating spool 15, and the motor 22 deactivates in the same manner as the pull-to-start mode.

Also in the on-board control mode, the dedicated-operator can deactivate the motor 22 by toggling the master switch 47, which disconnects power to the electronic speed controller 25. In the event that toggling the master switch 47 fails due to electronic speed controller 25 failure, the dedicated-operator hits the emergency stop button 46 to disconnect the battery supply 75 and deactivate the motor 22. After the emergency stop button 46 is manually opened, there is no load on the towrope 18 and the pivoting frame 12 returns to rest in the off position. The brake damper 37 applies the brake band 36 on the drum brake 35 to stop the rotating spool 15.

After deactivating the motor 22 by toggling the emergency stop button 46, the maximum speed potentiometer 53 is manually cycled down to zero ohms and back up to the desired maximum speed setting after power is returned to the electronic speed controller 25. This is a safety feature to prevent activating the motor 22 at full-speed upon returning power to the motor 22 in case the start button 52 or solenoid switch 48 fails.

The remote control mode is for both independent and dependent use. As with the on-board control mode, the towrope 18 riding length does not not need to be set to the desired length, but can be set so that the towee can activate the motor 22 with the pull-to-start mode if desired. The remote control mode functions in parallel with the pull-to-start and on-board control modes. The remote control mode has a wireless remote control 143, which allows for either the towee or the dedicated-operator, or both, to activate, deactivate and change speeds of the motor 22. The dedicated-operator may be near the mobile base 10 or far away within wireless range, but staying near the mobile base 10 provides the added benefit of being able to use controls 46, 47, 52, 53, 54 not on the wireless remote control 143 in case of a wireless remote control 143 failure. The towee places the wireless remote control 143 in a water-proof packing, such as a plastic bag, for water protection, and then secures the wireless remote control 143 to the body of the towee, so that the wireless remote control 143 is near while riding.

As with the pull-to-start and on-board control modes, the battery supply 75 is manually connected and the emergency stop button 46 and master switch 47 are manually closed, which turns the electronic speed controller 25 on. Then the maximum speed potentiometer 53 and the start-up speed potentiometer 54 are manually set to the desired limits prior to activating the motor 22. With the towee at the starting point with the handle 19 in hand, either the towee or the dedicated-operator presses and holds the wireless remote control start button 144 to activate the motor 22. As with the on-board control mode, the wireless remote control start button 144 only needs to be pressed until the pivoting frame 12 pivots to the fully-activated position. When the towee is riding, the pivoting frame 12 is in the fully-activated position. The motor 22 deactivates by the towee releasing the handle 19. The wireless remote control start button 144 is in parallel with the solenoid switch 48, so the only difference with activating the motor 22 in the pull-to-start and on-board control modes to the remote control mode is the dedicated-operator or towee presses the wireless remote control start button 144 to activate the motor 22 rather than the towee pulling on the towrope 18 or a dedicated-operator pressing the start button 52.

The remote control mode also has the ability to change the speed of the motor 22 while riding. Either the towee or dedicated-operator can manually press the wireless remote control half-speed button 145. The wireless remote control half-speed button 145 is wired in parallel with the half-speed switch 58, which completes power to half-speed terminal 111 of the electronic speed controller 25. The motor 22 stays at half-speed until the wireless remote control half-speed button 145 is manually pressed again to return the motor 22 to the speed set by the maximum speed potentiometer 53.

Also in the remote control mode, either the towee or dedicated-operator can deactivate the motor 22 by pressing the wireless remote control stop button 146 of the wireless remote control 143, which is connected in series with the solenoid switch 48. The wireless remote control stop button 146 disconnects power to the electronic speed controller 25 and solenoid 27, resulting in no power for the motor 22. As with the pull-to-start mode and on-board control mode, when the towee releases the handle 19, the pivoting frame 12 pivots backwards to the off position, the brake damper 37 applies the brake band 36 on the drum brake 35 to stop the rotating spool 15, and the motor 22 deactivates. The motor 22 stays deactivated until the wireless remote control stop button 146 is manually pressed again to turn on the electronic speed controller 25, and then the wireless remote control start button 144 is manually pressed to activate the solenoid 27 and allow current to pass through to the motor 22.

In the event that pressing the wireless remote control stop button 146 fails to deactivate the motor 22 due to electronic speed controller 25 failure or wireless remote control module 77 failure, the dedicated-operator manually presses the emergency stop button 46 to deactivate the motor 22. After the emergency stop button 46 is manually opened, there is no load on the towrope 18 and the pivoting frame 12 returns to rest in the off position. The brake damper 37 applies the brake band 36 on the drum brake 35 to stop the rotating spool 15 and then releases to allow the spool 15 to rotate again.

To reel in the excess towrope 18 on the spool 15 after riding, the half-speed switch 58 is manually toggled and the start button 52 is manually pressed and held until the towrope 18 is wound on the spool 15, or the wireless remote control half-speed button 145 is manually pressed and then the wireless remote control start button 144 is manually pressed and held until the towrope 18 is wound on the spool 15.

There are two modes to transport the mobile ski towing system, a manual-pull mode and a tow hitch mode. The manual-pull mode utilizes the wheels 70, 134, 135, 136 for transport, and the tow hitch connector 42 can be inserted between handle brackets 68, 131, 132, 133, as shown in FIG. 2, which are made of aluminum and welded to braces 65, 97 for easier manual pulling. The tow hitch connector 42 is secured to the handle brackets 68, 131, 132, 133 by two bolts. The tow hitch mode utilizes the tow hitch connector 42 to mount inside the tow hitch receiver of a navigable vehicle for transport.

Having explained the preferred embodiments of the present invention, those skilled in the art will readily recognize other applications and configurations that fall within the scope of the present invention. Many embodiments of the present invention can be made without departing from the spirit and scope of the present invention, which resides in the claims hereinafter appended.

What is claimed is:

1. A mobile ski towing system comprising:

a horizontal mobile base having a first side, a second side, a first edge, a second edge, a third edge, and a fourth edge;

an encompassing frame directly attached to the second side of the horizontal mobile base;

a pivot shaft having a proximal end and a distal end, wherein the proximal end of the pivot shaft is directly connected to the second side of the horizontal mobile base at the first edge of the horizontal mobile base with a first pivot shaft bearing, wherein the distal end of the pivot shaft is directly connected to the second side of the horizontal mobile base at the third edge of the horizontal mobile base with a second pivot shaft bearing;

a pivoting frame having a first side, a second side, a first edge, a second edge, a third edge, and a fourth edge, wherein the first side of the pivoting frame is directly connected to the pivot shaft to provide an axial motion about the pivot shaft, wherein the pivoting frame is housed within the encompassing frame;

an electric motor directly connected to the second side of the pivoting frame;

a spool directly connected to the electric motor with a spool shaft having a proximal end and a distal end, wherein the proximal end of the spool shaft is directly connected to the second side of the pivoting frame by a first spool shaft bearing, wherein the distal end of the spool shaft is directly connected to the second side of the pivoting frame by a second spool shaft bearing;

a towrope having a proximal end and a distal end, wherein the proximal end of the towrope is directly connected to a handle and the distal end of the towrope is directly connected to the spool;

a drum brake directly connected to the spool shaft;

a brake band having a proximal end and a distal end, wherein the proximal end of the brake band is directly connected to the pivoting frame and the distal end of the brake band is directly connected to a brake damper having a proximal end and a distal end, wherein the proximal end of the brake damper is directly connected to the distal end of the brake band and the distal end of the brake damper is directly connected to the encompassing frame, wherein the pivoting frame is tilted toward the first edge of the horizontal mobile base when a load is placed on the towrope so that the distal end of the brake damper extends to prevent the brake band from coming in direct contact with the drum brake, wherein the pivoting frame is tilted toward the second edge of the horizontal mobile base when a load is released on the towrope so that the distal end of the brake damper retracts to keep the brake band in direct contact with the drum brake;

a battery supply directly connected to the electric motor; and an electronic speed controller directly connected to the battery supply and to the electric motor.

2. The mobile ski towing system of claim 1, wherein the mobile ski towing system is used without a dedicated operator by using a pull-start mode or a wireless remote control module or with a dedicated operator by using a start button mounted on the mobile ski towing system.

3. The mobile ski towing system of claim 1, wherein the pivot shaft is substantially parallel to the second edge and the fourth edge of the horizontal mobile base.

4. The mobile ski towing system of claim 1, wherein the first edge of the pivoting frame is substantially parallel with the first edge of the horizontal mobile base.

5. The mobile ski towing system of claim 1, wherein the first side of the pivoting frame is directly connected to the pivot shaft with one or more U-bolts to provide an axial motion about the pivot shaft.

6. The mobile ski towing system of claim 1, further comprising a wireless remote control module connected to the battery supply.

7. The mobile ski towing system of claim 6, wherein the wireless remote control module is connected to the battery supply via a wireless remote control module battery connector.

8. A mobile ski towing system comprising:

a horizontal mobile base having a first side, a second side, a first edge, a second edge, a third edge, and a fourth edge;

an encompassing frame directly attached to the second side of the horizontal mobile base;

a pivot shaft having a proximal end and a distal end, wherein the proximal end of the pivot shaft is directly connected to the second side of the horizontal mobile base at the first edge of the horizontal mobile base with a first pivot shaft bearing, wherein the distal end of the pivot shaft is directly connected to the second side of the horizontal mobile base at the third edge of the horizontal mobile base with a second pivot shaft bearing, wherein the pivot shaft is substantially parallel to the second edge and the fourth edge of the horizontal mobile base;

a pivoting frame having a first side, a second side, a first edge, a second edge, a third edge, and a fourth edge, wherein the first side of the pivoting frame is directly connected to the pivot shaft to provide an axial motion about the pivot shaft, wherein the first edge of the pivoting frame is substantially parallel with the first edge of the horizontal mobile base, wherein the first side of the pivoting frame is directly connected to the pivot shaft with one or more U-bolts to provide an axial motion about the pivot shaft, wherein the pivoting frame is housed within the encompassing frame;

an electric motor directly connected to the second side of the pivoting frame;

a spool directly connected to the electric motor with a spool shaft having a proximal end and a distal end, wherein the proximal end of the spool shaft is directly connected to the second side of the pivoting frame by a first spool shaft bearing, wherein the distal end of the spool shaft is directly connected to the second side of the pivoting frame by a second spool shaft bearing;

a towrope having a proximal end and a distal end, wherein the proximal end of the towrope is directly connected to a handle and the distal end of the towrope is directly connected to the spool;

a drum brake directly connected to the spool shaft;

a brake band having a proximal end and a distal end, wherein the proximal end of the brake band is directly connected to the pivoting frame and the distal end of the brake band is directly connected to a brake damper having a proximal end and a distal end, wherein the proximal end of the brake damper is directly connected to the distal end of the brake band and the distal end of the brake damper is directly connected to the encompassing frame, wherein the pivoting frame is tilted toward the first edge of the horizontal mobile base when a load is placed on the towrope so that the distal end of the brake damper extends to prevent the brake band from coming in direct contact with the drum brake, wherein the pivoting frame is tilted toward the second edge of the horizontal mobile base when a load is released on the towrope so that the distal end of the brake damper retracts to keep the brake band in direct contact with the drum brake;

a battery supply directly connected to the electric motor;

an electronic speed controller directly connected to the battery supply and to the electric motor, and wherein the mobile ski towing system is used without a dedicated operator by using a pull-start mode.

9. A mobile ski towing system comprising:

a horizontal mobile base having a first side, a second side, a first edge, a second edge, a third edge, and a fourth edge;

an encompassing frame directly attached to the second side of the horizontal mobile base;

a pivot shaft having a proximal end and a distal end, wherein the proximal end of the pivot shaft is directly connected to the second side of the horizontal mobile base at the first edge of the horizontal mobile base with a first pivot shaft bearing, wherein the distal end of the pivot shaft is directly connected to the second side of the horizontal mobile base at the third edge of the horizontal mobile base with a second pivot shaft bearing, wherein the pivot shaft is substantially parallel to the second edge and the fourth edge of the horizontal mobile base;

a pivoting frame having a first side, a second side, a first edge, a second edge, a third edge, and a fourth edge, wherein the first side of the pivoting frame is directly connected to the pivot shaft to provide an axial motion about the pivot shaft, wherein the first edge of the pivoting frame is substantially parallel with the first edge of the horizontal mobile base, wherein the first side of the pivoting frame is directly connected to the pivot shaft with one or more U-bolts to provide an axial motion about the pivot shaft, wherein the pivoting frame is housed within the encompassing frame;

an electric motor directly connected to the second side of the pivoting frame;

a spool directly connected to the electric motor with a spool shaft having a proximal end and a distal end, wherein the proximal end of the spool shaft is directly connected to the second side of the pivoting frame by a first spool shaft bearing, wherein the distal end of the spool shaft is directly connected to the second side of the pivoting frame by a second spool shaft bearing;

a towrope having a proximal end and a distal end, wherein the proximal end of the towrope is directly connected to a handle and the distal end of the towrope is directly connected to the spool;

a drum brake directly connected to the spool shaft;

a brake band having a proximal end and a distal end, wherein the proximal end of the brake band is directly connected to the pivoting frame and the distal end of the brake band is directly connected to a brake damper having a proximal end and a distal end, wherein the proximal end of the brake damper is directly connected to the distal end of the brake band and the distal end of the brake damper is directly connected to the encompassing frame, wherein the pivoting frame is tilted toward the first edge of the horizontal mobile base when a load is placed on the towrope so that the distal end of the brake damper extends to prevent the brake band from coming in direct contact with the drum brake, wherein the pivoting frame is tilted toward the second edge of the horizontal mobile base when a load is released on the towrope so that the distal end of the brake damper retracts to keep the brake band in direct contact with the drum brake;

a battery supply directly connected to the electric motor;

an electronic speed controller directly connected to the battery supply and to the electric motor;

a wireless remote control module connected to the battery supply via a wireless remote control module battery connector, and wherein the mobile ski towing system is used with a dedicated operator by using a start button mounted on the mobile ski towing system.

* * * * *